US005090673A

United States Patent [19]

Kitahara et al.

[11] Patent Number: 5,090,673

[45] Date of Patent: Feb. 25, 1992

[54] SHEET POST TREATMENT APPARATUS

[75] Inventors: Yoshihiko Kitahara, Toride; Kenji Kobayashi, Tokyo, both of Japan

[73] Assignee: Canon Kabushiki Kaisha & Canon Aptex, Inc., Tokyo, Japan

[21] Appl. No.: 577,639

[22] Filed: Sep. 5, 1990

[30] Foreign Application Priority Data

Sep. 5, 1989 [JP] Japan ..... 1-230717

[51] Int. Cl.[5] ..... B42B 1/02

[52] U.S. Cl. ..... 270/53; 270/58; 271/254; 271/221

[58] Field of Search ..... 270/37, 53, 58; 271/221, 222, 253, 254; 414/788.9, 789.1

[56] References Cited

U.S. PATENT DOCUMENTS

| | | | |
|---|---|---|---|
| 4,685,793 | 8/1987 | Sawada | 271/253 |
| 4,928,941 | 5/1990 | Uto | 270/53 |
| 4,986,520 | 1/1991 | Shido et al. | 270/53 |

FOREIGN PATENT DOCUMENTS

| | | | |
|---|---|---|---|
| 301595 | 2/1989 | European Pat. Off. | 270/53 |
| 117870 | 5/1988 | Japan | 270/53 |
| 127977 | 5/1988 | Japan | 270/53 |
| 75360 | 3/1989 | Japan | 270/53 |

*Primary Examiner*—Edward K. Look
*Assistant Examiner*—Therese M. Newholm
*Attorney, Agent, or Firm*—Fitzpatrick, Cella, Harper & Scinto

[57] ABSTRACT

This invention relates to a sheet post treatment apparatus having receive means for receiving sheets, align means provided with a reference member providing a reference for aligning the sheets and a moving member movable relative to the reference member to align the sheets, and control means for controlling the aligning means to cause the moving member to wait at a different position in conformity with sheet size information before the discharge of the sheets in a case where the sheets discharged from an image forming apparatus are discharged so that the centers thereof may coincide with one another irrespective of the sizes of the sheets.

5 Claims, 13 Drawing Sheets

SHEET POST TREATMENT APPARATUS

BACKGROUND OF THE INVENTION

1. Field of the Invention

This invention relates to a sheet material post treatment apparatus, and more particularly to a sheet post treatment apparatus connected to an image forming apparatus such as a copying apparatus for aligning and receiving sheet materials discharged from the image forming apparatus.

2. Related Background Art

Heretofore, apparatuses of this kind (for example, sorters) have been designed such that sheet materials are discharged to the vicinity of the aligning reference wall of aligning means for the discharged sheets to be aligned or that the aligning reference wall is also operated in accordance with the size of the sheet materials.

Accordingly, the former construction could not cope with a case where sheets of different sizes are discharged so that the centers thereof may coincide with one another. The latter construction suffers from the disadvantage that the aligning reference wall is also moved and therefore the apparatus becomes complicated.

SUMMARY OF THE INVENTION

It is the object of the present invention to eliminate the above-noted disadvantages peculiar to the prior art and to provide a sheet post treatment apparatus which can align sheet materials different in width but discharged so that their centers may coincide with one another with a fixed reference wall within the shortest time, that is, which aligns and places sheet materials discharged after copying with the centers thereof as the reference onto a tray with one side thereof as the reference.

The present invention is preferably comprised of receiving means for receiving sheets, aligning means provided with a reference member providing a reference for aligning the sheets and a movable member movable relative to said reference member to align the sheets, and control means for controlling said aligning means to cause said movable member to wait at a different position in conformity with sheet size information before the discharge of the sheets in a case where the sheets discharged from an image forming apparatus are discharged so that the centers thereof may coincide with one another irrespective of the sizes thereof, whereby the sheets discharged from the image forming apparatus with the centers thereof as a reference are aligned within the shortest time conforming to the size of the sheets.

According to the present invention, where sheet materials of different sizes are discharged from an image forming apparatus so that the centers thereof may always coincide with one another, aligning of the sheets becomes possible within the shortest time in a simple construction in which an aligning reference wall is fixed and which has aligning means at the other end.

DESCRIPTION OF THE PREFERRED EMBODIMENTS

The invention will hereinafter be described in detail with reference to the drawings.

Figure 1:
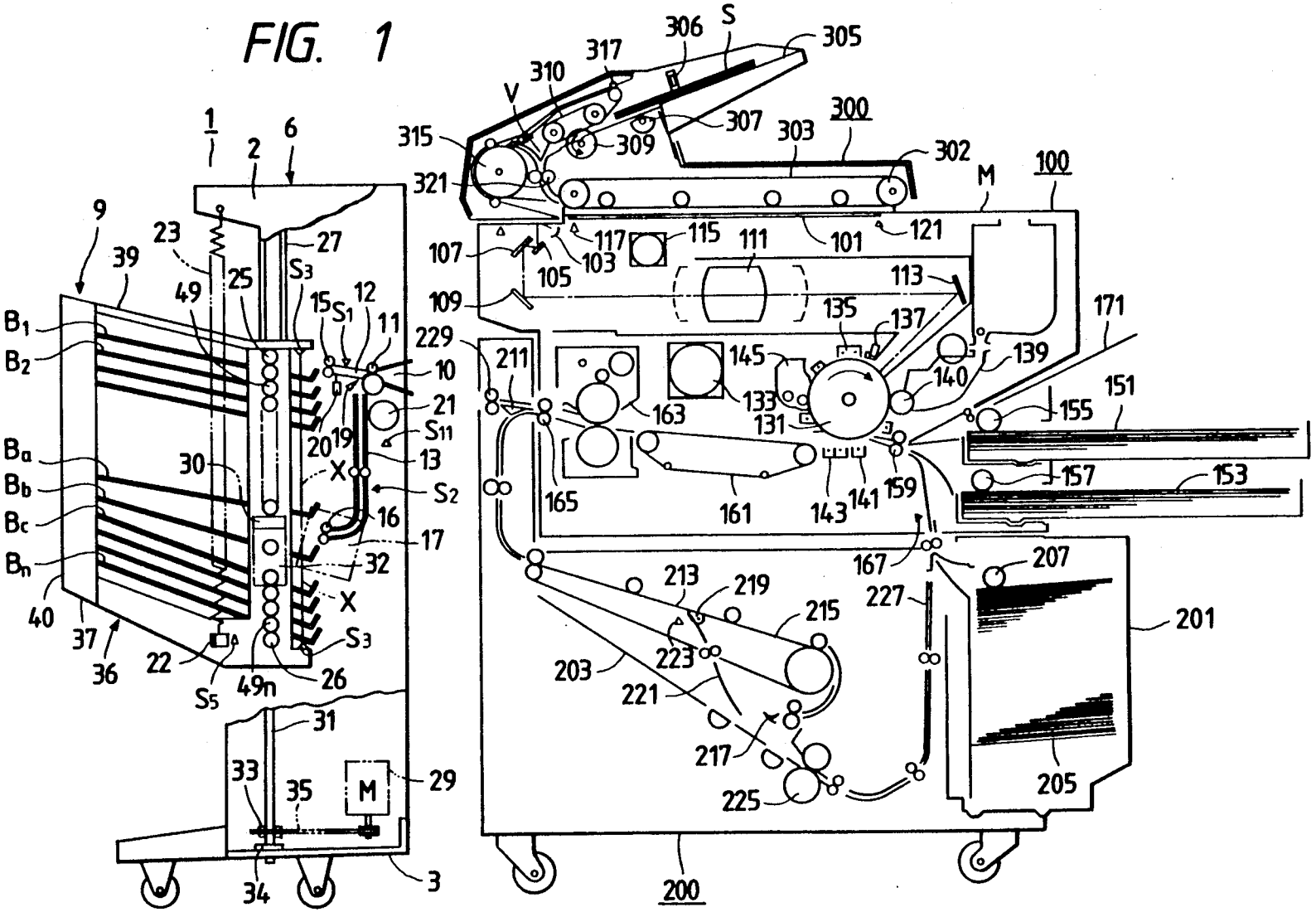
FIG. 1 is a cross-sectional view showing an example of the general construction of a copying apparatus according to the present invention.

Referring to FIG. 1 which shows an embodiment of the present invention, the reference numeral 1 designates a sheet post treatment apparatus (sorter), and the reference numeral 100 denotes a copying apparatus body. The sorter 1 will first be described.

Figure 2:
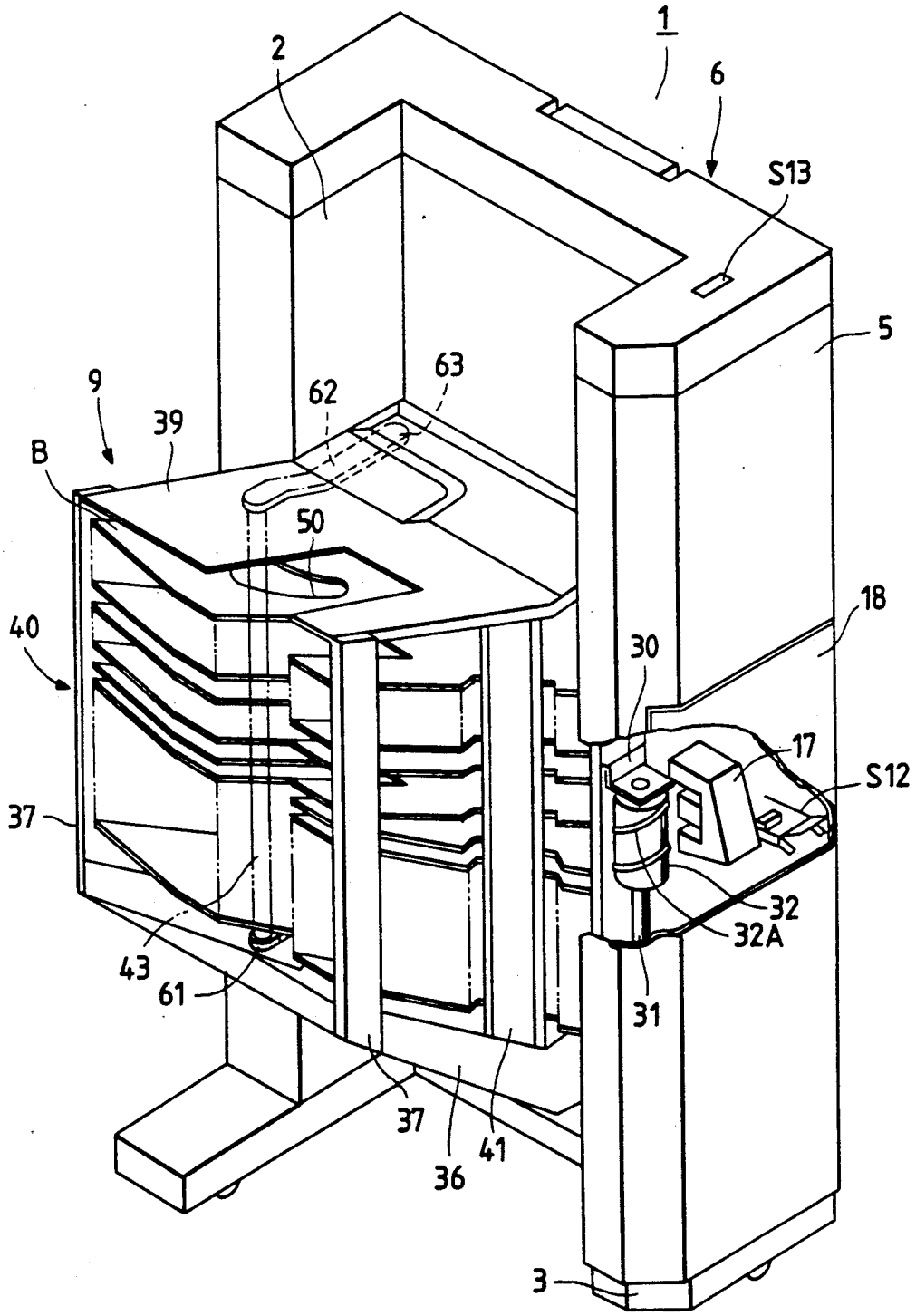
FIG. 2 is a perspective view showing the construction of a sorter according to the present invention.

The sorter 1, as shown in FIGS. 1 and 2, has a machine body 6 having a pair of opposed side plates 2, a base 3 and a cover 5, and a bin unit 9 provided with a number of bins B ($B_1$-$B_n$) and vertically movable.

Also, the machine body 6 is provided with a pair of carrying-in rollers 11 near a carrying-in port 10 for introducing sheets discharged from an image forming apparatus such as a copying apparatus, and a non-sort path 12 and a sort path 13 branching off from the non-sort path 12 are disposed downstream of the pair of carrying-in rollers 11. The non-sort path 12 is disposed substantially horizontally, and a pair of non-sort sheet discharge rollers 15 which provide a non-sort sheet discharge port are disposed downstream therefore, and the sort path 13 is downwardly extended, and a pair of sort sheet discharge rollers 16 which provide a sort sheet discharge port are disposed downstream thereof, and further a stapler 17 is disposed at a position associated with the pair of sort sheet discharge rollers 16.

A stapler door 18 and a door switch S12 are provided at a location opposed to the stapler 17 of the cover 5, as shown in FIG. 2, and the stapler door 18 is opened and closed when the needle of the stapler 17 is interchanged, and the opening-closing of the stapler door 18 is detected by the door switch S12.

A staple button S13 for non-sort sheet (manual operation) is disposed on the upper portion of the cover 5, and is depressed when the binding mode (the staple non-sort mode) for unsorted sheets P is selected.

Further, near the pair of carrying-in rollers 11, there are disposed a flapper 19 displaceable to change over the direction of conveyance of the sheets and a flapper solenoide 20 for driving the flapper 19. By the electrical energization of the flapper solenoid 20, the flapper 19 can be displaced to select the direction of conveyance of the sheets to the non-sort sheet discharge port 15 side, and by the deenergization of the flapper solenoid 20, the direction of conveyance of the sheets can be selected to the sort sheet discharge port 16 side. Further, a conveying motor 21 is disposed near the pair of carrying-in rollers 11, and the pair of carrying-in rollers 11, the pair of non-sort sheet discharge rollers 15 and the pair of sort sheet discharge rollers 16 are driven by the conveying motor 21.

A non-sort path sensor S1 is disposed on the non-sort path 12 and a sort path sensor S2 is disposed on the sort path 13, and further, on the conveying motor 21, there is disposed a conveyance clock sensor S11 for detecting the rotation thereof.

On the other hand, the bin unit 9 is disposed downstream of the pair of non-sort sheet discharge rollers 15 and the pair of sort sheet discharge rollers 16, and the bin unit 9, as shown in FIG. 1, has its weight carried by a spring 23 having one end thereof fixed to the machine body 6 and the other end thereof hooked to the hook 22 of the bin unit 9, and is supported for vertical movement. An upper guide roller 25 and a lower guide roller 26 are rotatably supported on the upper portion and the lower portion, respectively, of the base end side of the bin unit 9, and these upper and lower guide rollers 25 and 26 are fitted to a guide plate 27 vertically provided from the machine body 6 and roll in the guide plate 27 to guide the bin unit 9 when the bin unit 9 moves up and down.

Also, a bin unit driving motor 29 is disposed in the machine body 6 and further, a cam shaft holder 30 is disposed near the pair of sort sheet discharge rollers 16 of the machine body 6, and a lead cam shaft 31 is rotatably supported between the cam shaft holder 30 and a thrust bearing 34 disposed on the base 3. A lead cam 32 is disposed above the lead cam shaft 31, and a sprocket 33 is secured below the lead cam shaft 31, and a chain 35 is extended between the sprocket 33 and the bin unit driving motor 29, and the lead cam 32 is rotatable in forward and reverse directions by the bin unit driving motor 29 which selectively revolves in forward and reverse directions.

Figure 3:
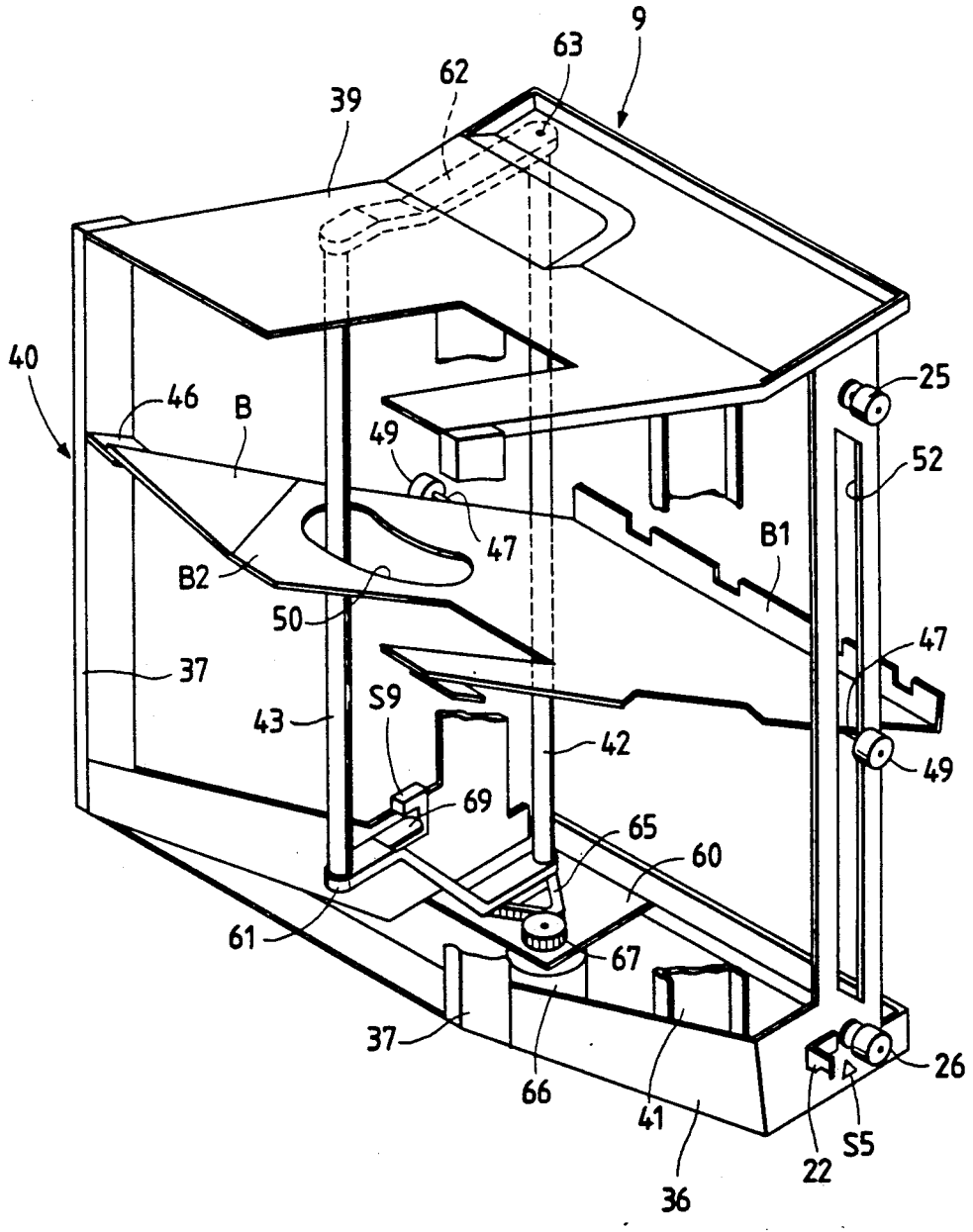
FIG. 3 is a perspective view showing the construction of a bin unit according to the present invention.

The bin unit 9 has a bin unit housing 40 comprised of a frame 36 comprising an inclined portion, a vertical portion and a horizontal portion, a vertical frame 37 vertically provided on the front and inner sides of the end of the inclined portion of the frame 36, and a bin cover 39 supported by the vertical frame 37, and an alignment reference plate 41 against which one end edge of the sheet is adapted to bear is provided on this side of the bin unit housing 40. Further, the bin unit 9 has a number of bins B ($B_1$–$B_n$) and is provided with an aligning rod 43 rockable about a movement center shaft 42, as shown in FIG. 3, and engagement plates 46 are formed on the opposite sides of the end of each bin B, as shown in detail in FIG. 4, and the engagement plates 46 are engaged with a support plate (not shown) provided inside the vertical frame 37, whereby the fore end side of each bin B is supported.

Also, roller supporting shafts 47 are fixed to the opposite sides of the base end of each bin B, and a bin roller (trunnion) 49 is rotatably supported on each supporting shaft 47. Furthermore, a slot 50 longer than the pivotal movement distance of the aligning rod 43 and sufficiently wider than the diameter of the aligning rod 43 is formed in each bin B at a predetermined distance from the movement center shaft 42. The base end portion B1 of each bin B rises vertically relative to a sheet receiving surface B2, and as shown in FIG. 1 to 3, by the bin B kept inclined at a predetermined angle relative to the machine body 6 with its fore end above, the sheet thereon slides on the sheet receiving surface B2 and the trailing end thereof bears against the base end portion B1, whereby the sheets are aligned in their longitudinal direction.

Also, in each bin B, the bin roller 49 protrudes from a slot 52 (see FIG. 3) formed in the base end portion of the bin unit body 40 and is fitted in the guide plate 27 of the machine body 6, and the bin roller 49 of an overlying bin B is supported by the bin roller 49 of an underlying bin B in such a manner that the bin roller **49*n* of the lowermost bin Bn is placed on the lower guide roller 26 and the bin roller 49 of the bin B just above the lowermost bin Bn is placed on the bin roller 49*n* of the lowermost bin Bn, whereby the base end portions of the bins $B_1$–$B_n$ are supported by the bin unit body 40**.

Figure 6:
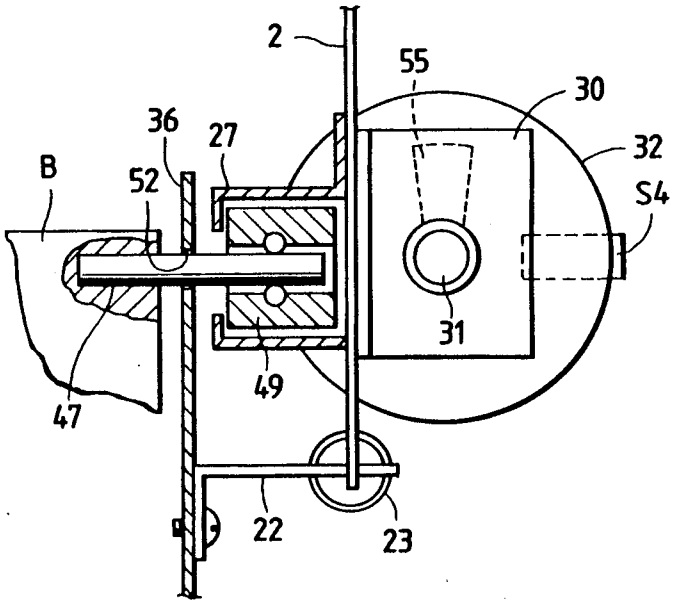
FIG. 6 is a top plan view of the sorter driving device of FIG. 5.
Figure 5:
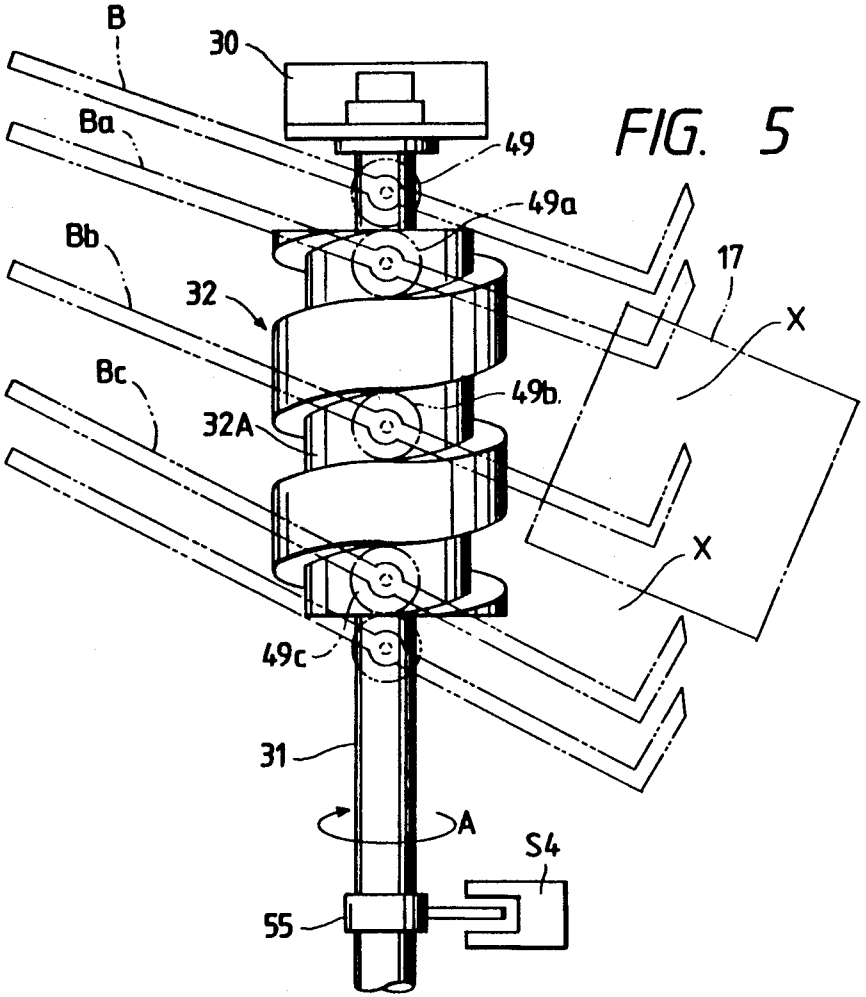
FIG. 5 illustrates a sorter driving device according to the present invention.

Furthermore, the lead cam 32 is formed with a spiral cam slot 32A somewhat wider than the diameter of the bin roller 49, as shown in FIGS. 5 and 6, and the lead cam 32, during the rotation thereof, brings the bin roller 49 of the bin B lying at a location opposed to the pair of sort sheet discharge rollers 16 into the cam slot 32A, and as shown in FIG. 5, one full rotation of the lead cam 32 in the direction of arrow A moves the bin roller **49*c* of the bin Bc to the intermediate position (indicated by 49*b* in FIG. 5) of the lead cam 32, and one more full rotation of the lead cam 32 moves the bin roller 49*c* to the position (indicated by 49*a* in FIG. 5) in which it comes out of the cam slot 32A in the lead cam 32. When the lead cam 32 further makes one full rotation, the bin roller 49*a* which has been at the position 49*a* pushes up the overlying bin roller 49 and at the same time, as shown in FIG. 1, that overlying bin roller 49 pushes up a further overlying bin roller 49, and the uppermost bin roller 49 pushes up the upper guide roller 25 and thus, the bin unit 9** is elevated step by step.

Thus, with the movement of the bin roller 49, the bins $B_1$–$B_n$ are successively moved upwardly and at that time, at the location opposed to the pair of sort sheet discharge rollers 16, as shown for example, in FIGS. 1 and 5, between the bin Bb for receiving the sheet from the pair of sort sheet discharge rollers 16 and the bins Ba and Bc overlying and underlying the bin Bb, there are formed openings X and X wider than the spacing between the other bins B. Thus, by the rotation of the lead cam 32, the bin unit 9 is moved upwardly or downwardly. Also, as shown in FIGS. 1 and 3, a bin home position sensor S5 is disposed near the hook 22, and by the bin home position sensor S5, the bin unit 9 which has been moved to the lowermost home position is detected.

As shown in FIGS. 5 and 6, a flag 55 is fixed to the lead cam shaft 31, and a lead cam sensor S4 is disposed at a location opposed to the flag 55, and by the lead cam sensor S4 detecting the flag 55, one full rotation of the lead cam 32 is detected and the stopped position of the lead cam 32 is also detected.

Also, transmission type in-the-bin sheet detecting sensors S3 and S3 are disposed on the upper and lower portions of the base end of the bin unit 9 (see FIG. 1), and when all the sheets are taken out of the bin unit 9, the absence of sheets is detected by in-the-bin sheet detecting sensors S3 ans S3 and the termination of one cycle of work is judged.

Figure 4:
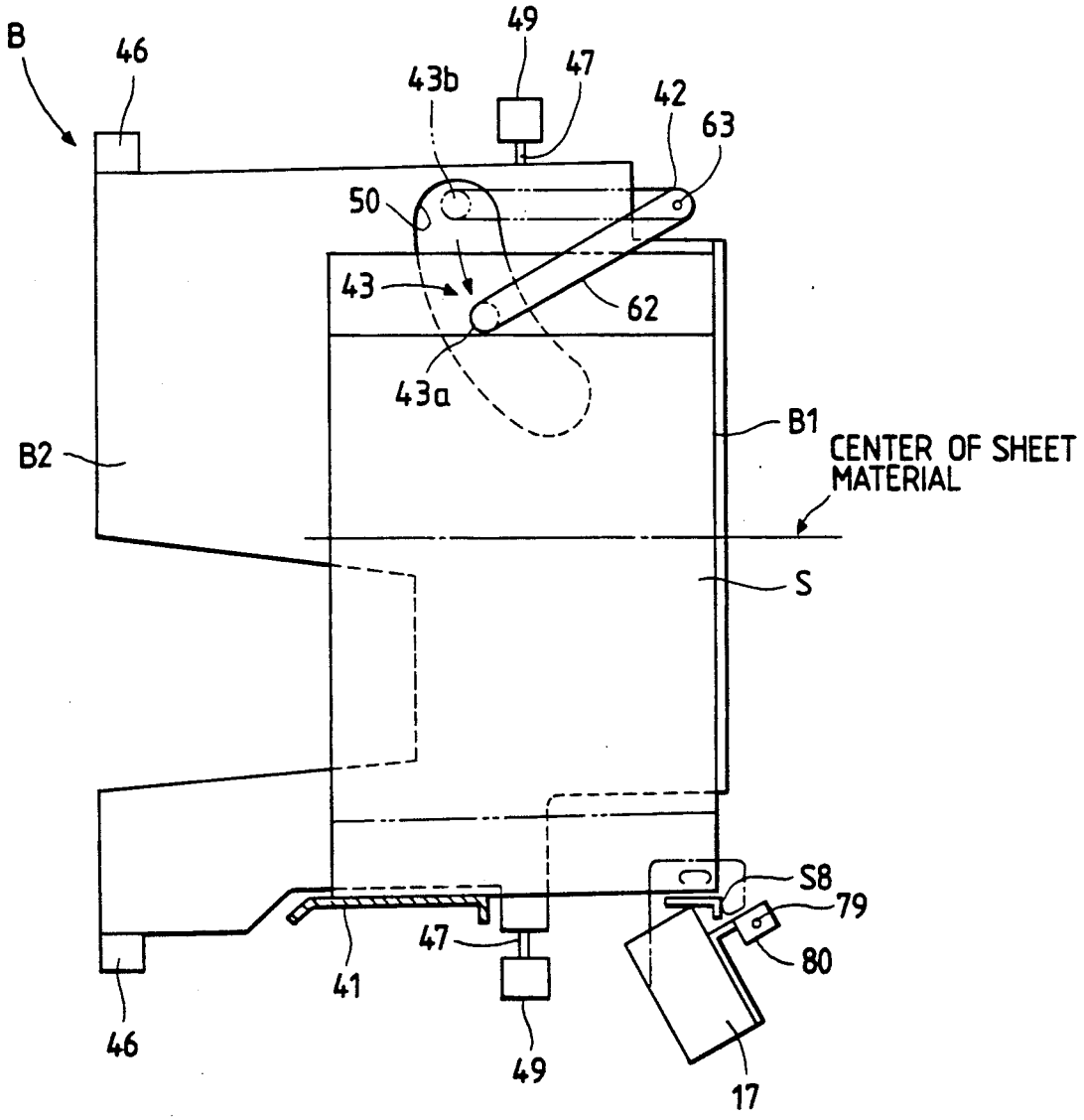
FIG. 4 is a top plan view of the bin unit of FIG. 3.

The alignment of sheets by the aligning rod 43 will hereinafter be described with reference to FIGS. 3 and 4.

A support plate 60 is provided on the lower side of the base end of the frame 36 of the bin unit 9, and a lower arm 61 is pivotally supported on the support plate 60 and has one end thereof rotatably supported on a lower rotary shaft (not shown) upwardly projected from the support plate 60. Also, the lower end portion of the moving center shaft 42 is fixed to one end of the lower arm 61 coaxially with the lower rotary shaft, and the lower end portion of the aligning rod 43 is fixed to the other end of the lower arm 61, and further the upper end portion of the aligning rod 43 and the upper end portion of the moving center shaft 42 are coupled together by an upper arm 62. Thereby, the aligning rod 43 and the moving center shaft 42 are constructed integrally with the upper arm 62 and the lower arm 61. Furthermore, the moving center shaft 42 is pivotally supported on an upper rotary shaft 63 downwardly projected from the bin cover 39, whereby the aligning rod 43 is kept rockable about the moving center shaft 42. Further, a sector gear 65 whose center of rotation coincides with the center of movement of the lower arm 61 is fixed to the lower arm 61, and an aligning rod driving motor 66 is disposed below the support plate 60. The output gear 67 of the aligning rod driving motor 66 is in meshing engagement with the sector gear 65, whereby the aligning rod 43 can be rocked by the revolution of the motor 66.

Thus, the aligning rod 43, when aligning the sheets, moves from the home position (not shown) to the lateral register position 43*a* determined correspondingly to the size of the sheet, bears against the end edge of the sheet and cooperates with the alignment reference plate 41 to align the sheet, and further moves to the waiting position 43*b*, in which it waits in preparation for the aligning of the next sheet.

The aligning rod driving motor 66 is a stepping motor, and the amount of movement of the aligning rod 43 is determined by a given pulse number.

A light-intercepting plate 69 is fixed to the lower arm 61, as shown in FIG. 3, and by the light-intercepting plate 69 being moved with the lower arm 61, an aligning rod home position sensor S9 secured to the frame 36 is turned on and off.

Figure 7:
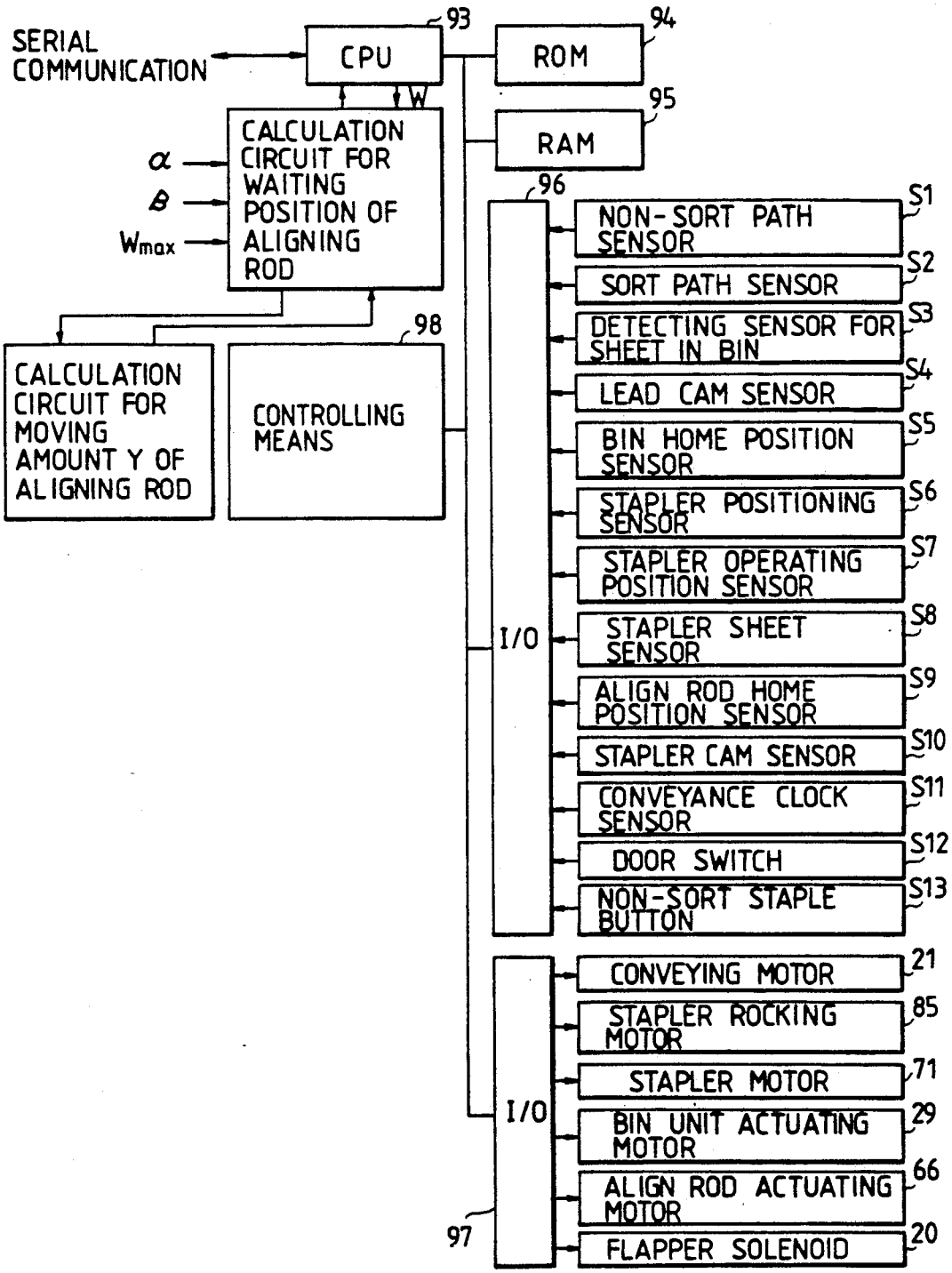
FIG. 7 is a block diagram of a control circuit according to the present invention.

The sorter 1, as shown in FIG. 7, is provided with a controller comprising a central processing unit (CPU) 93, a read-only memory (ROM) 94, a random access memory (RAM) 95, an input port 96 and an output port 97. A control program is stored in the ROM 94, and input data and data for work are stored in the RAM 95. The above-mentioned non-sort path sensor S1 to sensor S13 and switches are connected to the input port 96, and motors for the sorter and driving means such as a solenoid, besides the above-described conveying motor 21, are connected to the output port 97, and the CPU 93 controls each portion connected through a path, in accordance with the control program stored in the ROM 94. The CPU 93 is provided with a serial interface, and effects serial communication, for example, with the CPU (not shown) of the copying apparatus body 100 and controls each portion by a signal from the copying apparatus body.

The above-described controller is provided with control means 98 programmed so as to discharge sheets onto the bins B capable of binding sheets so that even in a case where the sheets are not sorted (not-sort), the sheets can be bound. Where the staple non-sort mode (a mode in which sheets not sorted are bound) is selected, when the above-mentioned non-sort staple button S13 is depressed, the control means 98 deenergizes the flapper solenoid 20 on the basis of a signal from the button S13, and controls the flapper 19 so that it may be displaced and the sheet S may be discharged from the sort discharge port 16. Thus, the sheet S is discharged from the sort discharge port 16 through the flapper 19 onto the bin B capable of binding the sheet S, and is bound by that bin B. Thereby, the binding of non-sort sheets which could heretofore not be bound becomes possible.

The procedure of the sheet post treatment operation by the present embodiment will now be described with respect to flow charts shown in FIGS. 8 to 14.

Figure 8:
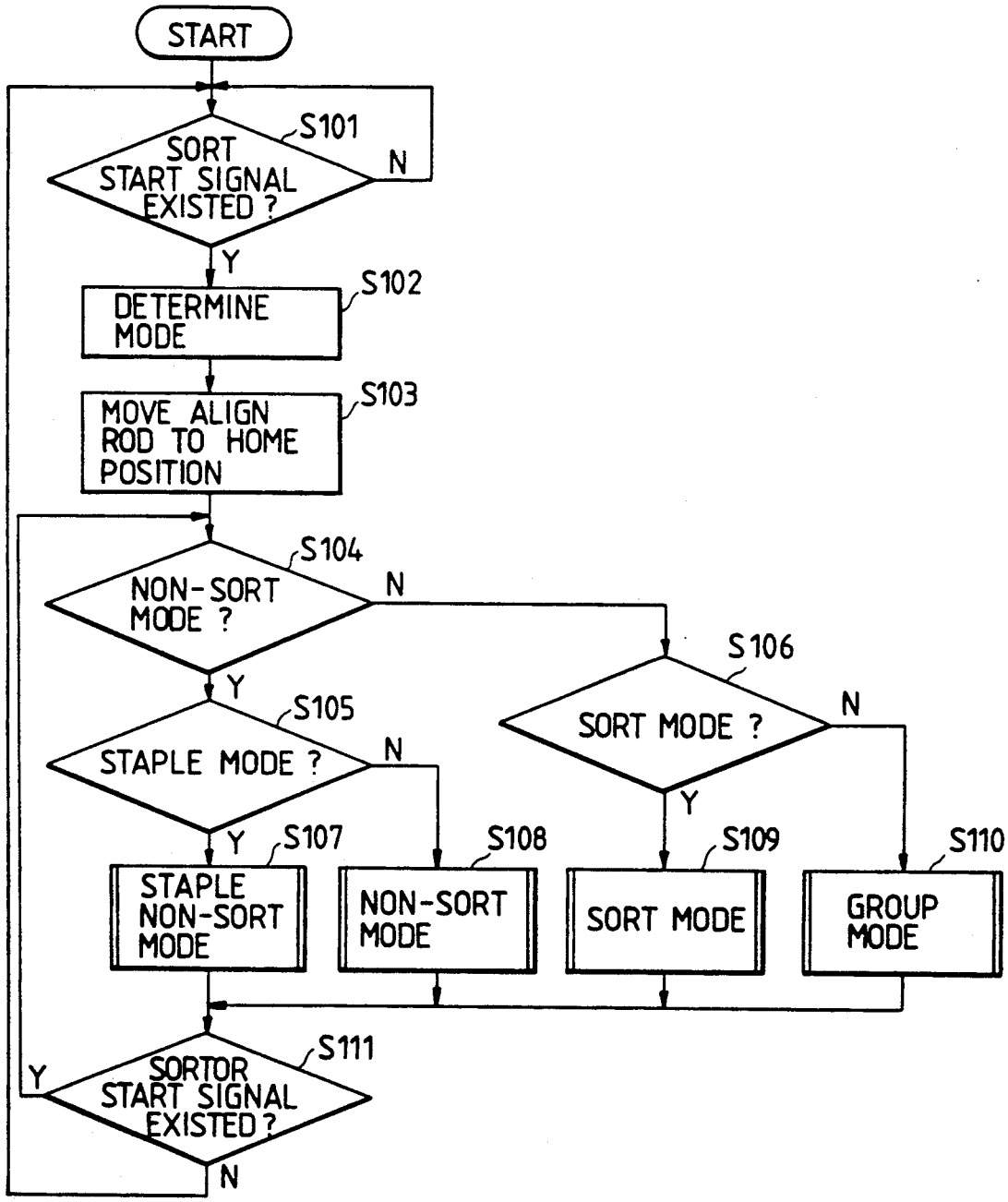
FIG. 8 is a flow chart showing the procedure of the sort selecting operation according to the present invention.

First, when as shown in FIG. 8, for example, the copy start key of the copying apparatus body 100 is depressed to start the copying operation, a sorter start signal is sent from the CPU of the copying apparatus body 100 to the CPU 93 by a serial signal. So, in the CPU 93, this sorter start signal is waited for (step 101), and when the sorter start signal is sent thereto, advance is made to a step 102, where the mode of the operation during one job until the sorter start signal becomes null is determined and the mode data is stored into the RAM 95. Then, at a step 103, for the detection of the position of the aligning rod 43, the aligning rod 43 is returned to the home position, and then, each portion is operated on the basis of the mode determined at the step 102. That is, at a step 104, whether the current mode is the non-sort mode is judged, and if it is the non-sort mode, whether staple should be done is judged (step 105). When staple should be done, advance is made to the staple non-sort mode of a step 107, and when staple should not be done, advance is made to the non-sort mode of a step 108.

If at the step 104, it is judged that the current mode is not the non-sort mode advance is made to a step 106, where whether the current mode is the sort mode is judged. If the current mode is the sort mode, advance is made to a step 109, and if the current mode is not the sort mode, it is judged that the current mode is the group mode, and advance is made to a step 110.

After the termination of an operation conforming to any of the above-described modes, advance is made to a step 111, where whether a sorter start signal exists, that is, whether one job has been terminated, is judged. If the sorter start signal exists, it is judged that one job is not yet terminated, and return is made to the step 104. If the sorter start signal does not exist, it is judged that one job has been terminated, and the program proceeds to the first step 101.

Figure 9:
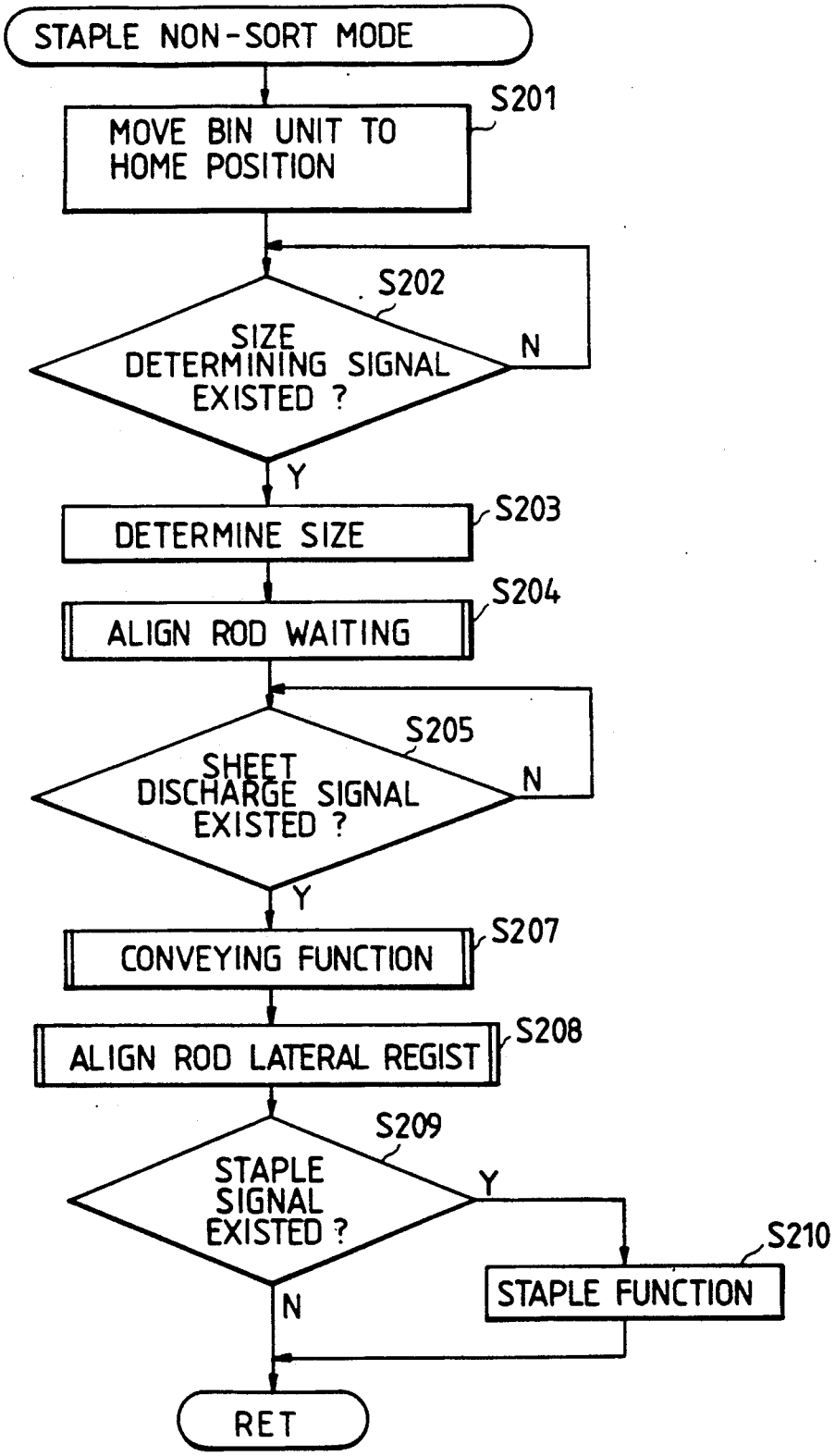
FIGS. 9, 11, 12 and 13 are flow charts showing the procedures of the operations in the staple mode, the non-sort mode, the sort mode and the group mode according to the present invention.

The operation in the staple non-sort mode will now be described with reference to FIG. 9.

In the case of the staple non-sort mode, at a step 201, the bins B are first moved to the home position, and at the next step 202, a size determining signal sent from the copying apparatus body 100 is waited for. Waiting for the size determining signal to be input, advance is made to a step 203, where the aligning rod waiting position is calculated, and the aligning rod waiting position is stored into the RAM 95. The calculation is effected as follows.

Figure 10A:
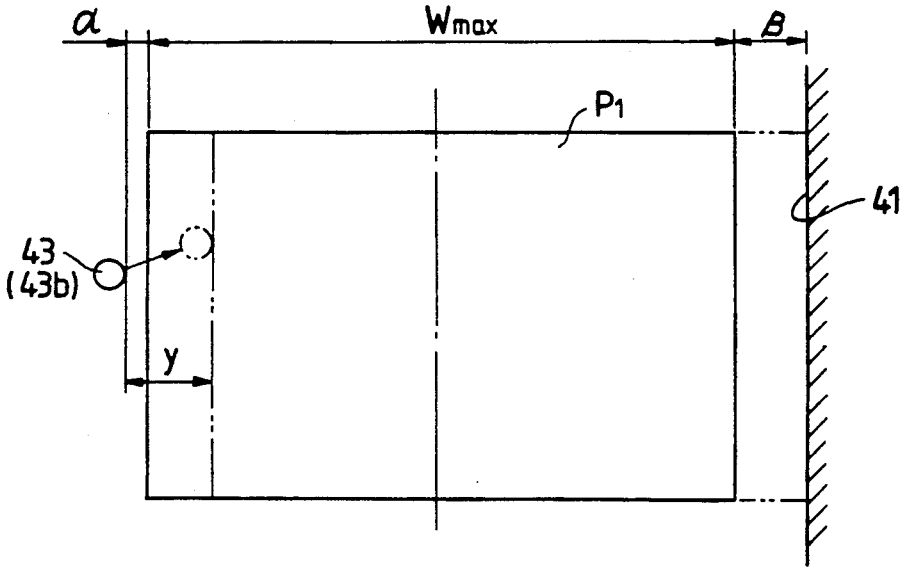
FIGS. 10A and 10B shows the relation between the aligning rod waiting position and the position of a sheet material.
Figure 10B:
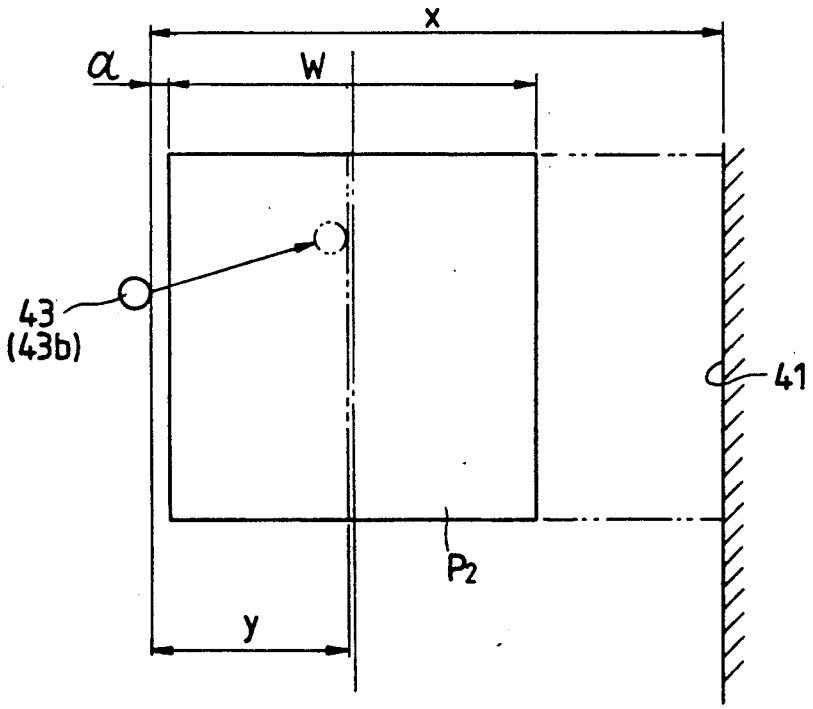

When in FIGS. 10A and 10B, the width of the sheet material is W and the maximum width of the sheet material is Wmax and the distance from the movable alignment reference wall to the end of the sheet material is $\beta$ and the distance from the alignment reference wall to that portion of the aligning means which bears against the sheet is X and the appropriate margin when the sheet is discharged onto the tray is $\alpha$, $$x = \beta + \frac{W_{max}}{2} + \frac{W}{2} + \alpha \quad (1)$$

Likewise, the moving amount y of the aligning rod is also calculated on the basis of the size of the sheet.

$$y = x - W \quad (2)$$

Then, at a step 204, the aligning rod 43 is once moved to the lateral register position (the standby position) 43*b*, whereby the aligning rod is brought into the waiting state. Thereafter, at a step 205, the sheet discharge signal from the copying apparatus body 100 is waited for, and when the sheet discharge signal has come, advance is made to a step 207, where the sheet S discharged from the copying apparatus body 100 is introduced into the bin B, whereafter at a step 208, the aligning rod 43 is brought near to thereby align the sheet. Thereafter, at a step 209, whether a staple signal has come from the copying apparatus body 100 is judged, and if the staple signal exists, advance is made to a step 210, and if the staple signal does not exist, the operation in the staple non-sort mode is terminated, and the program returns to the main routine. Also, at the step 210, the staple function of binding the sheets in the bin B is performed, whereafter return is made to the main routine.

FIG. 10A shows the state immediately after a sheet $P_1$ of maximum widthwise size has been discharged with the center as the reference, and in this state, the aligning rod 43 is waiting at the home position. When the discharge is terminated, the aligning rod 43 is moved to right to push the sheet $P_1$ to right and hold it to the alignment reference plate 41. The aligning rod 43 is receiprocally moved each time a sheet is discharged.

FIG. 10B shows the state immediately after a sheet $P_2$ of small widthwise size has been discharged with the center as the reference, and in this state, the aligning rod 43 is waiting at the standby position (43*b*) calculated from the aforementioned equation (1). When the discharge is terminated, the aligning rod 43 pushes the sheet $P_2$ against the alignment reference plate 41. The aligning rod is reciprocally moved between the standby position and the pushing position each time a sheet is discharged.

Figure 11:
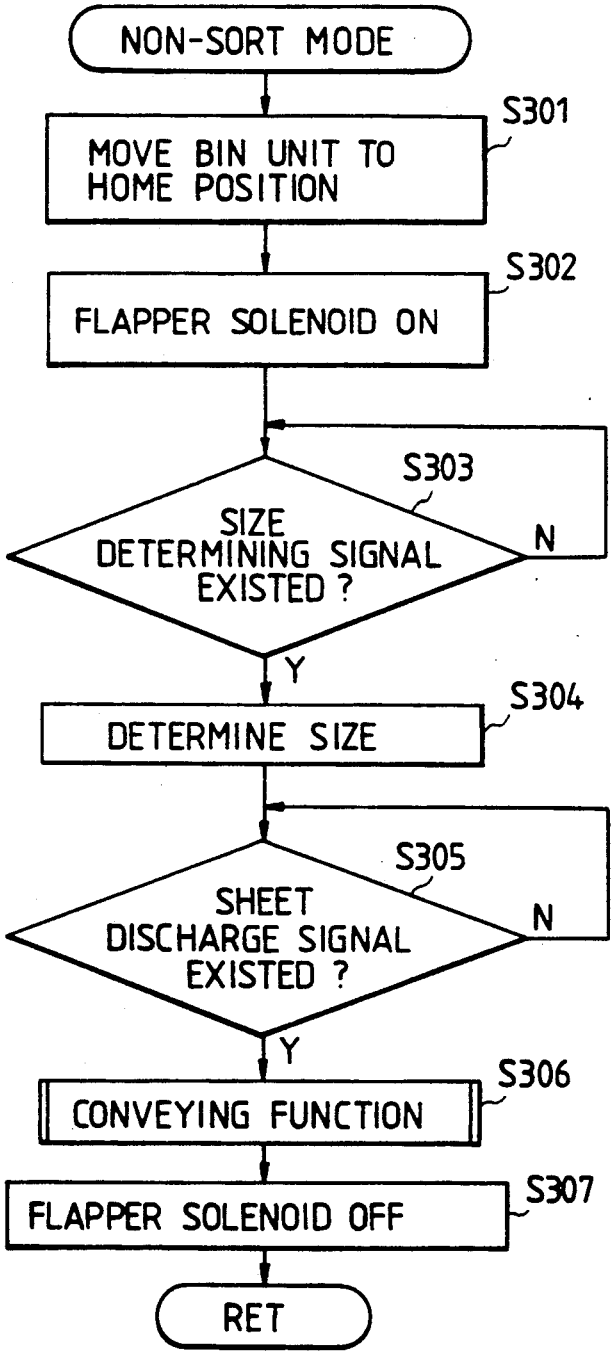

The operation in the non-sort mode will now be described with reference to FIG. 11.

In the case of the non-sort mode, the bins B on the non-sort tray are used and therefore, at a step 301, the bins B are returned to the home position, and at a step 302, the flapper solenoid 20 is energized to secure the non-sort path 12. Then, at a step 303, the size determining signal from the copying apparatus body 100 is waited for, and when the size determining signal is input, advance is made to a step 304, where the size is stored into the RAM 95, and at the next step 305, a sheet discharge signal is waited for, and when the sheet discharge signal has come, advance is made to a step 306, where the conveying function for discharging sheets onto the bins B on the non-sort tray is performed, and at a step 307, the flapper solenoid 20 is deenergized, thus terminating the operation in the non-sort mode.

Figure 12:
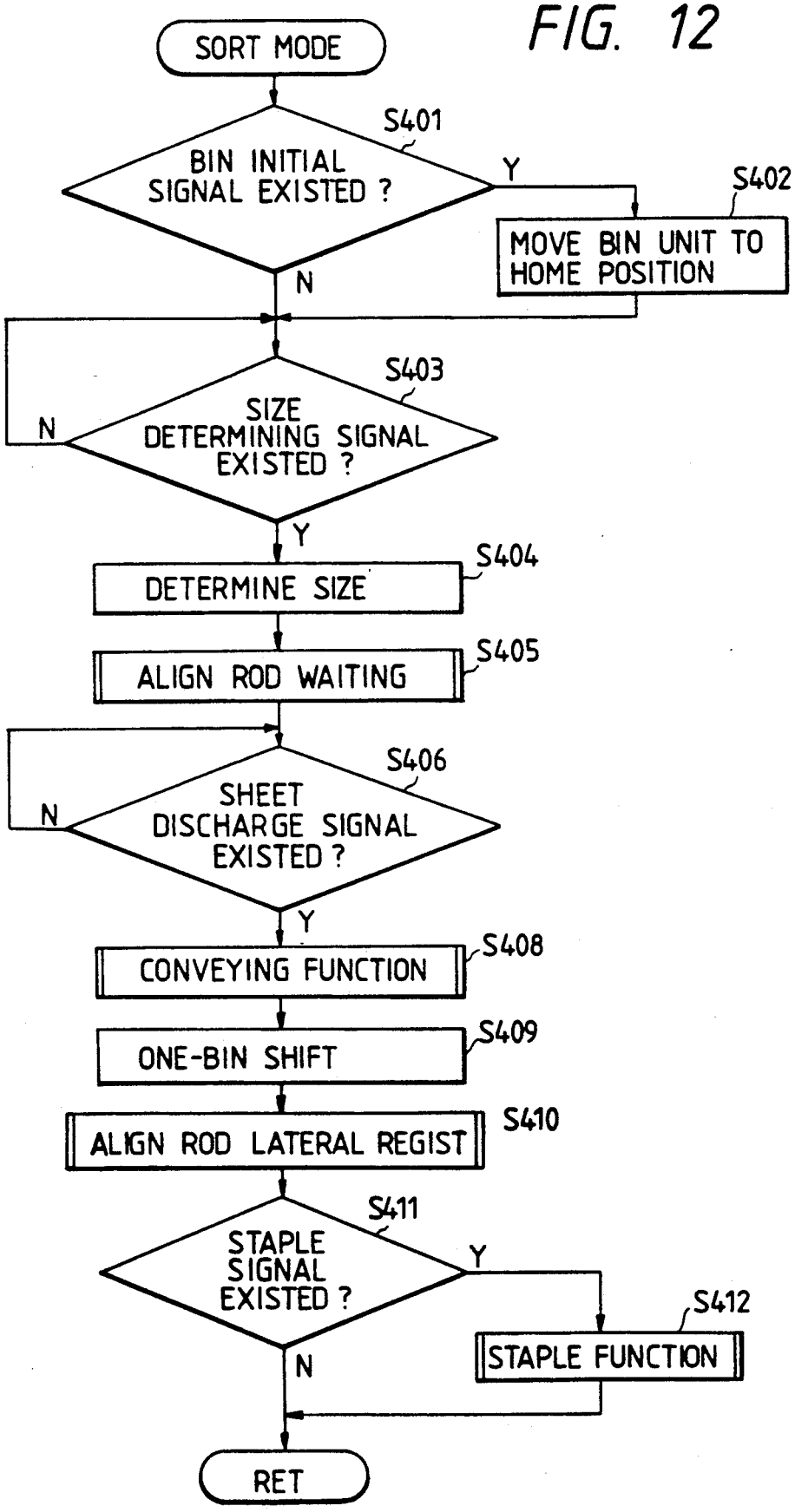

The operation in the sort mode will now be described with reference to FIG. 12.

In the case of the sort mode, at a step 401, whether a bin initial signal has been input from the copying apparatus body 100 is judged, and only when the bin initial signal exists, at a step 402, the bin unit 9 is returned to the home position, and advance is made to a step 403. At this step, the size determining signal is waited for, and if the size determining signal is input, at a step 404, the aligning rod waiting position is calculated and it is stored into the RAM 95, and then at a step 405, the aligning rod 43 is caused to wait at the lateral register position 43*b*. Then at a step 406, the sheet discharge signal from the copying apparatus body 100 is waited for, and if the sheet discharge signal is input, at a step 408, the sheet S is conveyed into the bin B.

After the conveying function has thus been terminated, at a step 409, one-bin shift is effected, and at a step 410, the aligning rod 43 is laterally registered to align the sheet, whereafter at a step 411, whether the staple signal from the copying apparatus body 100 exists is judged, and the staple function is performed, thus terminating the sorting operation.

Figure 13:
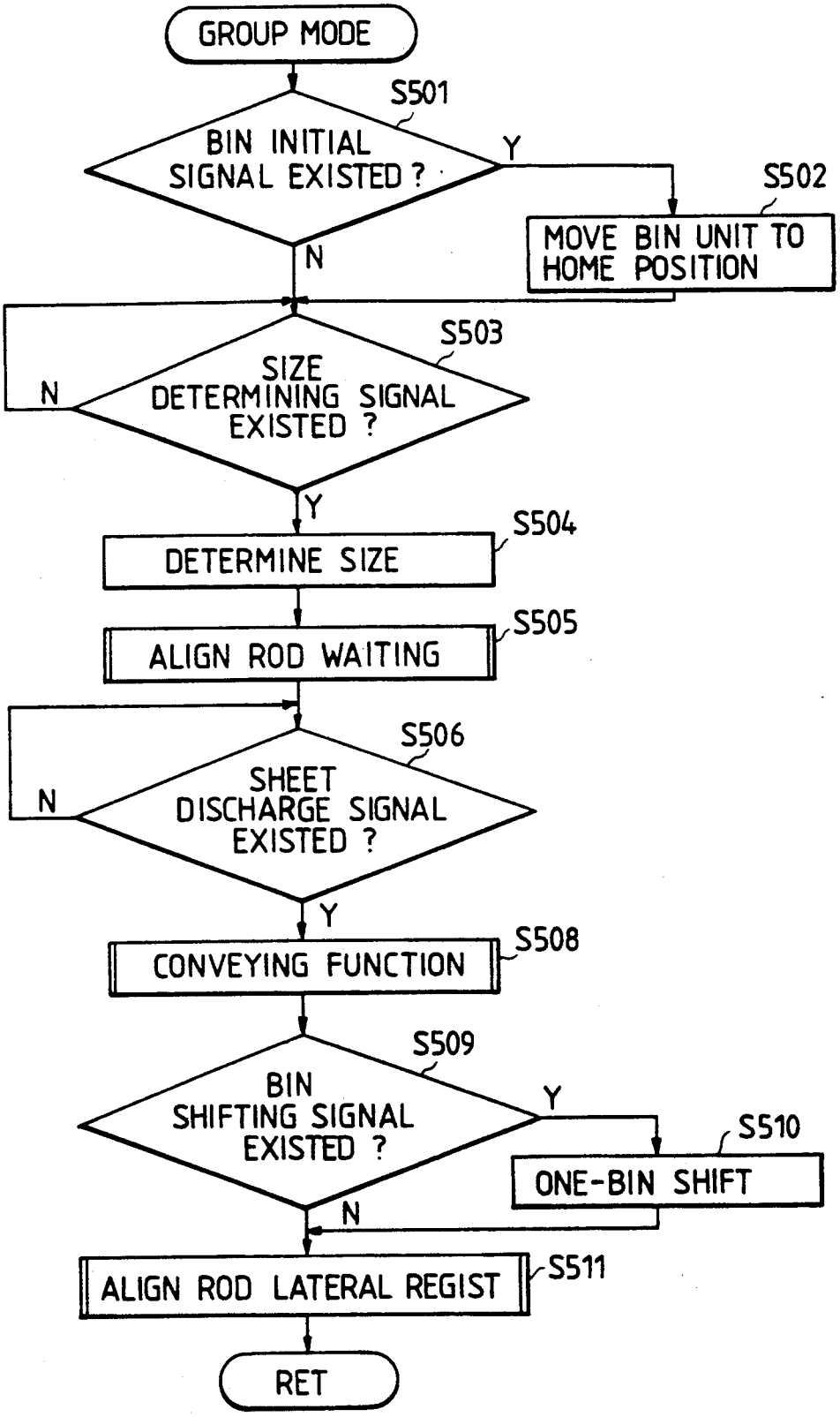

The group mode will now be described with reference to FIG. 13.

In the group mode, first at a step 501, the presence or absence of the inputting of the bin initial signal from the copying apparatus body 100 is judged, and only when the inputting of the bin initial signal exists, at a step 502, the bin unit 9 is returned to the home position. At the next step 503, the size determining signal from the copying apparatus body 100 is waited for, and if the size determining signal is input, at a step 504, the aligning rod waiting position is calculated and it is stored into the RAM 95, and advance is made to a step 505, where the aligning rod 43 is brought to the lateral register position 43*b* and is caused to wait at this position. Then, at a step 506, the sheet discharge signal from the body 100 is waited for, and if the sheet discharge signal is input, at a step 508, the sheet is conveyed to the bin B. Thereafter, at a step 509, the presence or absence of a bin shifting signal from the copying apparatus body 100 is judged, and only when the inputting of the bin shifting signal exists, advance is made to a step 510, where one-bin shift is effected, and at the next step 511, the aligning rod 43 is laterally registered to align the sheet. Also, if at the step 509, the bin shifting signal does not exist, at the step 511, the aligning rod 43 is laterally registered thus terminating the operation in the group mode.

In the present embodiment of the present invention, in the case of the non-staple mode, the aligning rod is not operated in any of the sort mode and the non-sort mode, and the sheets are piled on the tray with the center thereof as the reference.

Figure 14:
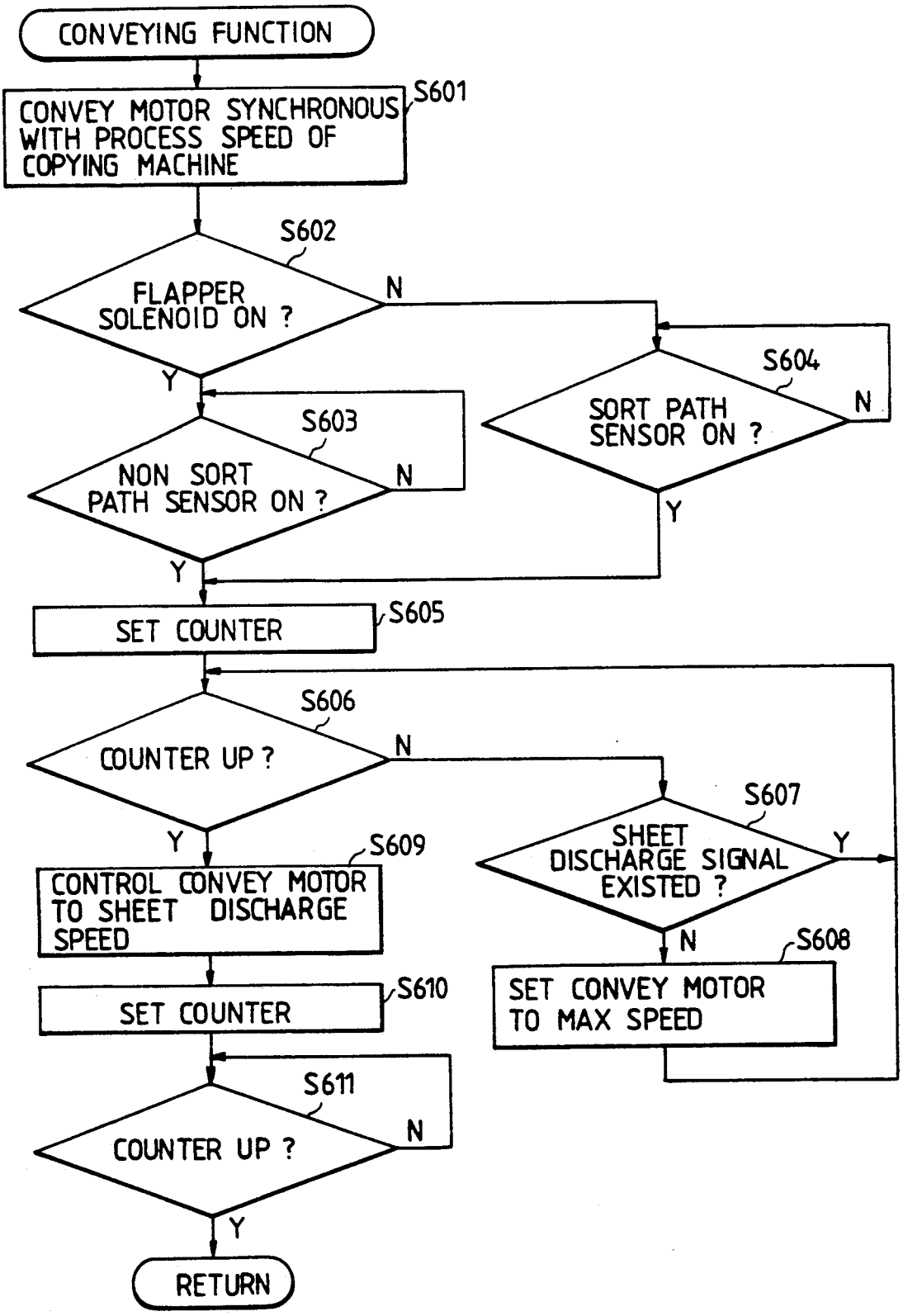
FIG. 14 is a flow chart showing the procedure of the conveying operation.

The conveying function will now be described with reference to FIG. 14.

Where the sorter 1 receives a sheet from the copying apparatus body 100 by a series of conveying functions, if the conveyance speed of the sheet in the sorter 1 is lower than the discharge speed of the sheet from the copying apparatus body 100, the sheet will form a loop between the sorter 1 and the copying apparatus body 100, thus causing sheet jam. Also, if the conveyance speed of the sheet S in the sorter 1 is higher than the discharge speed of the sheet from the copying apparatus body 100, the sheet will be pulled between the two, and this may lead to the production of abnormal sound or the danger of the sheet being damaged.

So, first, at a step 601, the conveyance speed of the sorter 1 is synchronized with the process speed of the copying apparatus body 100, and then at a step 602, whether the flapper solenoid 20 is energized, that is, which of the sort discharge port 16 and the non-sort discharge port 15 is selected is judged. If the flapper solenoid 20 is ON, the non-sort discharge port 15 is selected and therefore, at a step 603, the program waits for the non-sort path sensor S1 to detect the sheet S, and if the flapper solenoid 20 is OFF, the sort discharge port 16 is selected and therefore, the program branches off to a step 604, where the program waits for the sort path sensor S2 to detect the sheet.

If at the step 603, the sensor S1 is ON or at the step 604, the sensor S2 is ON, the program proceeds to a step 605. At the step 605, a counter for point measurement for controlling the conveying motor 21 during the discharge of the sheet is set, and at a step 606, whether the set counter has completed counting is judged, and if the counter has counted up, advance is made to a step 609, and if the counter has not counted up, advance is made to a step 607.

At the step 607, whether the sheet discharge signal from the copying apparatus body 100 exists is judged, and only when the sheet discharge signal does not exist, it is judged that the sheet has come out of the copying apparatus body 100, and advance is made to a step 608, where the conveyance speed is set to a maximum speed. Advance is made to the step 609 after at the step 606, the point for effecting the control during the discharge has been judged, and the conveying motor 21 is controlled to the sheet discharge speed of the copying apparatus body 100. Thereafter, at a step 610, a counter for measuring the discharge completion point is set, and at a step 611, the program waits for the count to be up, and thus a series of conveying functions are terminated.

The copying apparatus body 100 will now be described.

In the body 100, the reference numeral 101 designates platen glass on which an original is placed, the reference numeral 103 denotes an illuminating lamp (exposure lamp) for illuminating the original, the reference numerals 105, 107 and 109 designate scanning mirrors for changing the optical path of the original, the reference numeral 111 denotes a lens having the focusing and magnification changing functions, the reference numeral 113 designates a fourth reflecting mirror (scanning mirror) for changing the optical path, the reference numeral 115 denotes an optical system motor for driving the optical system, and the reference numerals 117 and 121 designate sensors.

The reference numeral 131 denotes a photosensitive drum, the reference numeral 133 designates a main motor for driving the photosensitive drum 131, the reference numeral 135 denotes a high voltage unit, the reference numeral 137 designates a blank exposure unit, the reference numeral 139 denotes a developing device, the reference numeral 140 designates a developing roller, the reference numeral 141 denotes a transfer charger, the reference numeral 143 designates a separating charger, and the reference numeral 145 denotes a cleaning device.

The reference numeral 151 designates an upper cassette, the reference numeral 153 denotes a lower cassette, the reference numeral 171 designates a manual supply opening, the reference numerals 155 and 157 denote sheet feed rollers, and the reference numeral 159 designates register rollers. The reference numeral 161 denotes a conveying belt for conveying a recording sheet on which an image has been recorded to the fixating side, the reference numeral 163 designates a fixating device for fixating the conveyed recording sheet by heat pressing, the reference numeral 165 denotes rollers for feeding the fixated sheet t a pedestal or a sorter which will be described later, and the reference numeral 167 designates a sensor used to detect the sheet during both-side recording.

The surface of the photosensitive drum 131 comprises a seamless photosensitive member using a photoelectric conductor and an electrical conductor, and this drum 131 is rotatably journalled and starts to be rotated in the direction of arrow by the main motor 133 operated in response to the depression of a copy start key which will be described later. When the predetermined rotation control and the potential control process (anteprocess) of the drum 131 are terminated, the original placed on the platen glass 101 is illuminated by the illuminating lamps 103 constructed integrally with the first scanning mirror 105, and the reflected light from the original is imaged on the drum 131 via the first scanning mirror 105, the second scanning mirror 107, the third scanning mirror 109, the lens 111 and the fourth scanning mirror 113.

The drum 131 is corona-charged by the high voltage unit 135, whereafter the image (the image of the original) illuminated by the illuminating lamp 103 is slit-exposed, and is formed as an electrostatic image on the drum 131 by the well-known Carlson system.

Subsequently, the electrostatic image on the photosensitive drum 131 is developed by the developing roller 140 of the developing device 139 and visualized as a toner image, which will be transferred onto a transfer sheet by the transfer charger 141, as will be described later.

On the other hand, transfer sheets in the upper cassette 151 or the lower cassette 153 or transfer sheets set in the manual supply opening 171 are fed one by one into the apparatus body by the sheet feed roller 155 or 157 or the manual supply roller. The transfer sheet is further fed toward the photosensitive drum 131 by the register rollers 159 with accurate timing, and the leading end edge of the latent image and the leading end edge of the transfer sheet are brought into coincidence with each other. Thereafter, the transfer sheet passes between the transfer charger 141 and the drum 131, whereby the toner image on the drum 131 is transferred onto the transfer sheet. After the termination of this transfer, the transfer sheet is separated from the drum 131 by the separating charger 143, and is directed to the fixating device 163 by the conveying belt 161, and the image on the transfer sheet is fixated by pressing and heating, whereafter the transfer sheet is discharged out of the body 100 by the discharge rollers 165.

The drum 131 after the image transfer continues to rotate and the surface thereof is cleaned by the cleaning device 145 comprised of a cleaning roller and an elastic blade.

The reference numeral 200 designates a pedestal for once receiving the sheet delivered from the copying apparatus body 100 and holding it for post treatment. The pedestal 200 can be disconnected from the body 100, and has a deck 201 capable of containing 2,000 transfer sheets therein and a intermediate tray 203 for both-side copying. The lifter 205 of the deck 201 capable of containing 2,000 sheets therein is moved upwardly in conformity with the quantity of the transfer sheets so that the transfer sheets may always bear against a sheet feed roller 207.

The reference numeral 211 designates a sheet discharge flapper for changing over the path on the both-side recording side or the multiplex recording side and the path on the discharge side, the reference numerals 213 and 215 denote the conveyance paths of the conveying belt, and the reference numeral 217 designates an intermediate tray weight for holding down the transfer sheets. The transfer sheets passed through the sheet discharge flapper 211 and the conveyance paths 213 and 215 are turned out and contained in the intermediate tray 203 for both-side printed copies. The reference numeral 219 denotes a flapper for selecting the path for both-side recording and the path for multiplex recording. The flapper 219 is disposed between the conveyance paths 213 and 215 and is upwardly pivotable to thereby direct the transfer sheets to a conveyance path 221 for multiplex recording. The reference numeral 223 designates a multiplex sheet discharge sensor for detecting the distal end of the transfer sheet when the flapper 21 is driven. The reference numeral 225 denotes a sheet feed roller for refeeding the transfer sheets toward the drum 131 through a path 227, and the reference numeral 229 designates discharge rollers for discharging the transfer sheets out of the apparatus.

During both-side recording (both-side copying) and multiplex recording (muliplex copying), the sheet discharge flapper 211 of the body 100 is first pivoted upwardly and a transfer sheet on which copying has been effected is contained in the intermediate tray 203 through the conveyance paths 213 and 215 in the pedestal 200. At this time, in the case of both-side recording, the flapper 219 is lowered, and in the case of multiplex recording, the flapper 219 is elevated. The intermediate tray 203 can contain therein, for example, up to 99 transfer sheets, and the transfer sheets contained in the intermediate tray 203 are held down by the intermediate tray weight 217. During back-side recording o multiplex recording to be effected subsequently, the transfer sheets contained in the intermediate tray 203 are directed one by one from below to the register rollers 159 in the body 100 through the path 227 by the actions of the sheet feed roller 225 and the weight 217.

The reference numeral 300 designates a recurrent or recycle type original feeder (hereinafter referred to a "RDF") for successively feeding originals in a recurrent manner. In the RDF 300, the reference numeral 305 denotes a supporting tray on which a bundle of originals S is set. In the supporting tray 305, a separating motor (not shown) is first driven in the case of one-side originals, whereby the originals are separated one by one from the lowermost portion of the bundle of originals by a semi-circular roller 307, a separating and conveying roller 309 and a separating belt 310, and by a belt motor 302 being driven, the original is conveyed to the exposure position on the platen glass 101 by register rollers 321 and a whole surface belt 303 and is thereafter stopped at the exposure position, and the copying (reading) operation is started. After the termination of the copying (reading) operation, the motor 302 is again driven, whereby the original is directed to a path V by a large conveying roller 315 and is further returned to the upper surface of the bundle of originals S by sheet discharge rollers 317. The reference numeral 306 denotes a recycle lever for detecting one cycle of recurrence of the originals. At the start of the original feeding, the recycle lever 306 is kept placed on top of the bundle of originals, and when the originals are successively fed and the trailing end edge of the last original passes the recycle lever 306, the recycle lever 306 falls from gravity to thereby detect one cycle of recurrence of the originals.

We claim:

1. A sheet post treatment apparatus comprising:

receiving means for receiving sheets;

align means provided with a reference member providing a reference for aligning the sheets, and a moving member movable relative to said reference member to align the sheets; and control means for controlling said align means to cause said moving member to wait at a different position in conformity with sheet size information before the discharge of the sheets in a case where the sheets discharged from an image forming apparatus are discharged so that the centers thereof may coincide with one another irrespective of the sizes of the sheets, wherein assuming the width of the discharged sheets is W, the maximum width of the discharge sheets is Wmax, the distance from that portion of said moving member which bears against the sheet to the end of the sheet is $\alpha$, the distance from said reference member to the end of the sheet of the maximum width is $\beta$, and the distance from said reference member to that portion of said moving member which bears against the sheet is x, said control means causes said moving member to wait at a position which satisfies the following relation:

$$x = \beta + \frac{W_{max}}{2} + \frac{W}{2} + \alpha.$$

2. A sheet post treatment apparatus according to claim 1, wherein said control means moves said moving member by a moving amount y toward said reference member during the aligning of the sheet, and said moving amount y satisfies:

$$y = x - W.$$

3. A sheet post treatment apparatus according to claim 2, wherein after the aligning of the sheet, said control means moves said moving member by the moving amount y away from said reference member.

4. A sheet post treatment apparatus according to claim 1, wherein said moving member is moved during the staple mode, and is not moved during the non-staple mode.

5. An image forming apparatus, comprising:

image forming means for forming an image on sheets;

receiving means for receiving sheets on which said images have been formed by said image forming means;

align means provided with a reference member providing a reference for aligning the sheets, and a moving member movable relative to said reference member to align the sheets; and control means for controlling said align means to cause said moving member to wait at a different position in conformity with sheet size information before the discharge of the sheets in a case where the sheets discharged from an image forming apparatus are discharge so that the centers thereof may coincide with one another irrespective of the sizes of the sheets, wherein assuming the width of the discharged sheets is W, the maximum width of the discharged sheets is Wmax, the distance from that portion of said moving member which bears against the sheet to the end of the sheet is $\alpha$, the distance from said reference member to the end of the sheet of the maximum width is $\beta$, and the distance from said reference member to that portion of said moving member which bears against the sheet is x, said control means causes said moving member to wait at a position which satisfies the following relation:

$$x = \beta + \frac{W_{max}}{2} + \frac{W}{2} + \alpha.$$

* * * * *

UNITED STATES PATENT AND TRADEMARK OFFICE

CERTIFICATE OF CORRECTION

PATENT NO. : 5,090,673

DATED : February 25, 1992

INVENTOR(S) : KITAHARA, ET AL.

It is certified that error appears in the above-identified patent and that said Letters Patent is hereby corrected as shown below:

COLUMN 4

Line 31, "roller 49a" should read --roller 49--.
Line 64, "ans" should read --and--.

COLUMN 6

Line 29, "staple" should read --stapling-- (both occurrences).
Line 31, "staple" should read --stapling--.

COLUMN 7

Line 35, "receiprocally" should read --reciprocally--.

COLUMN 10

Line 2, "t" should read --to--.

UNITED STATES PATENT AND TRADEMARK OFFICE

CERTIFICATE OF CORRECTION

PATENT NO. : 5,090,673

DATED : February 25, 1992

INVENTOR(S) : KITAHARA, ET AL.

It is certified that error appears in the above-identified patent and that said Letters Patent is hereby corrected as shown below:

COLUMN 11

Line 18, "21" should read --219--.
Line 35, "o" should read --or--.

COLUMN 12

Line 19, "discharge" should read --discharged--.
Line 63, "discharge" should read --discharged--.

Signed and Sealed this

Twenty-fourth Day of August, 1993

Bruce Lehman

*Attest:*

BRUCE LEHMAN

*Attesting Officer*

*Commissioner of Patents and Trademarks*